US009566813B2

(12) United States Patent
Syrjanen et al.

(10) Patent No.: US 9,566,813 B2
(45) **Date of Patent: *Feb. 14, 2017**

(54) DATA CARRIER WITH SEE-THROUGH WINDOW AND METHOD FOR PRODUCING IT

(71) Applicant: Gemalto Oy, Vantaa (FI)

(72) Inventors: Taru Syrjanen, Vantaa (FI); Teemu Pohjola, Meudon (FR)

(73) Assignee: Gemalto Oy, Vantaa (FI)

( * ) Notice: Subject to any disclaimer, the term of this patent is extended or adjusted under 35 U.S.C. 154(b) by 279 days.

This patent is subject to a terminal disclaimer.

(21) Appl. No.: 14/045,301

(22) Filed: Oct. 3, 2013

(65) Prior Publication Data

US 2014/0037868 A1 Feb. 6, 2014

Related U.S. Application Data

(62) Division of application No. 12/519,981, filed as application No. PCT/IB2007/003901 on Dec. 5, 2007, now Pat. No. 8,568,864.

(30) Foreign Application Priority Data

Dec. 18, 2006 (EP) ..... 06026184

(51) Int. Cl.

| | |
|---|---|
| ***B05D 5/06*** | (2006.01) |
| ***B41M 3/14*** | (2006.01) |
| ***B44F 1/10*** | (2006.01) |
| ***B42D 25/41*** | (2014.01) |
| ***B42D 25/351*** | (2014.01) |

(Continued)

(52) U.S. Cl.

CPC ..... *B41M 3/14* (2013.01); *B42D 25/351* (2014.10); *B42D 25/382* (2014.10); *B42D 25/387* (2014.10); *B42D 25/391* (2014.10); *B42D 25/41* (2014.10); *B44F 1/10* (2013.01); *B41M 3/144* (2013.01); *Y10T 428/24802* (2015.01);

(Continued)

(58) Field of Classification Search

None

See application file for complete search history.

(56) References Cited

U.S. PATENT DOCUMENTS

| | | | |
|---|---|---|---|
| 3,640,009 | A | 2/1972 | Komiyama |
| 4,304,809 | A | 12/1981 | Moraw et al. |

(Continued)

FOREIGN PATENT DOCUMENTS

| | | | |
|---|---|---|---|
| EP | 1348575 | A1 | 10/2003 |
| EP | 1719637 | A2 | 11/2006 |

(Continued)

OTHER PUBLICATIONS

Office Action issued Oct. 3, 2011 in JP Application No. 2009-542254.

(Continued)

*Primary Examiner* — Christopher Polley

(74) *Attorney, Agent, or Firm* — Panitch Schwarze Belisario & Nadel LLP

(57) ABSTRACT

The invention relates to a data carrier having a see-through portion (24) that allows revealing security features (36) with a different appearance on each of its sides (S1, S2) under special lighting conditions, and a method for making such a data carrier. The see-through portion has an improved security, which is more difficult to reproduce by infringers.

16 Claims, 6 Drawing Sheets

(51) Int. Cl.
*B42D 25/382* (2014.01)
*B42D 25/387* (2014.01)
*B42D 25/391* (2014.01)

(52) U.S. Cl.
CPC ..... *Y10T 428/24851* (2015.01); *Y10T 428/24868* (2015.01)

(56) References Cited

U.S. PATENT DOCUMENTS

| | | | |
|---|---|---|---|
| 5,982,737 | A | 11/1999 | Takagishi et al. |
| 6,089,614 | A | 7/2000 | Howland et al. |
| 7,879,415 | B2 | 2/2011 | Hoshino et al. |
| 2010/0047488 | A1 | 2/2010 | Syrjanen et al. |

FOREIGN PATENT DOCUMENTS

| | | | |
|---|---|---|---|
| EP | 1719637 | A3 | 6/2012 |
| JP | 11-025508 | A | 1/1999 |
| JP | 2005-346866 | A | 12/2005 |
| JP | 2006-103048 | A | 4/2006 |
| WO | 2004/009373 | A | 1/2004 |
| WO | 2006018171 | A2 | 2/2006 |
| WO | 2006018171 | A3 | 7/2006 |

OTHER PUBLICATIONS

Office Action issued Jul. 6, 2012 in U.S. Appl. No. 12/519,981.
Office Action issued Sep. 18, 2015 in EP Application No. 07849020.8.

DATA CARRIER WITH SEE-THROUGH WINDOW AND METHOD FOR PRODUCING IT

CROSS-REFERENCE TO RELATED APPLICATIONS

This application is a divisional of co-pending U.S. patent application Ser. No. 12/519,981, filed Sep. 24, 2009, which was a Section 371 of International Application No. PCT/IB2007/003901, filed Dec. 5, 2007, which was published in the English language on Jun. 26, 2008, under International Publication No. WO 2008/075164 A2, the disclosure of which is incorporated herein by reference.

BACKGROUND OF THE INVENTION

This invention relates generally to a data carrier and a method for making the data carrier. More particularly, this invention relates to a data carrier having a see-through portion that allows revealing security features with a different appearance under special lighting conditions, and a method for making such a data carrier.

Data carriers, such as driving licenses, identity cards, membership cards, badges or passes, passports, discount cards, banking cards, money cards, multi-application cards, and other papers of value; and security documents such as bank notes are widely used. Because of the value and importance associated with each of these data carriers, they are often the subject of unauthorized copying and alterations, and forgeries.

To prevent such activities from being carried out on these data carriers, different types of visual and touchable security features have been added to data carriers. One of these security features is a clear or see-through portion through the body of a data carrier.

One prior art method of making a card with a see-through window involves printing white ink on a surface of a transparent core layer, leaving an unprinted area for defining a see-through window. The method further includes laminating the printed surface of the transparent core layer with a protective layer.

Another prior art method of making a card with a see-through window involves creating an orifice in an opaque layer and sandwiching the opaque layer between two transparent layers to create a see-through window through the two transparent layers A further prior art method of making such a card involves making an orifice in each of a pair of opaque layers. The pair of opaque layers are laminated onto opposite sides of a transparent layer with the orifices aligned to form a see-through window.

A yet further prior art method of making such a card includes creating an orifice in an opaque white core layer, and filling the orifice with transparent plastic to define a see-through window in the opaque layer The applicant has also found a further method that is simpler and cost-effective for producing a data carrier with a see-through window whose edge is more clearly defined and which does not weaken the structure of the card. Such a data carrier is schematized in cross-sectional view in FIG. 1. This method includes applying a layer of separation material 14 to a surface of one of an at least translucent layer 16 and a backing layer 8, and fixedly attaching the other of the translucent layer and the backing layer to that surface of the layer. The backing layer 8 may be less translucent than the translucent layer 16. In other words, less light passes through the backing layer than the translucent layer. The backing layer may be an opaque layer. The separation material 14 prevents a part of the backing layer abutting it from being completely fixedly attached to the translucent layer. The method further includes removing at least a portion 25 of the backing layer 8 abutting the separation material 14 to uncover a portion of the translucent layer adjacent the portion of the opaque layer. The uncovered portion of the translucent layer defines a see-through portion 24 of the data carrier. The method further includes a non-mandatory step consisting in removing the separation material 14 that is exposed after the portion of the backing layer abutting it has been removed.

Markings are then created at the transparent layer 16, wherein a laser beam (not shown) is irradiated to create markings 34 at the transparent layer 16. These markings 34 may include, but are not limited to, personalized information and data, such as name, date of birth, address, personal number, signature, portrait, etc. These markings 34 are created at portions of the transparent layer 16 that are backed by the backing layer 8, which aids legibility of the markings 34. A security feature 36 is also created at the window 24 of the transparent layer 16. Security feature 36 may include, but is not limited to, an hologram or a fingerprint, or an iris scan, etc. . . . . These markings 34, 36 may be created on an outer surface of the inner surface of the transparent layer 16 or within the volume of the transparent layer 16.

All data carriers having a see-through portion, manufactured according to any known process, may have security markings created on the surface or within the volume of the see-through portion. However, infringers can still copy or alter the security markings of the existing see-through windows. Infringers can also try to remove a basic window and try to replace it with something else or insert it into another data carrier.

Considering the above, a problem intended to be solved by the invention is to provide a data carrier comprising an at least translucent layer defining a see-through portion of the data carrier, said see-through portion having a first side and a second side and carrying security markings, said see-through portion having an improved security, being even more difficult to reproduce by infringers, even more difficult to remove, replace or exchange and easy to check.

BRIEF SUMMARY OF THE INVENTION

The solution of the invention to this problem relates to the fact that the see-through portion comprises a developer material, which is able to change the appearance of said security markings when read from the first side, under specific lighting conditions, and a filtering material, which is able to filter at least partially of said lighting radiations, so that said security markings have another appearance from the second side of the see-through portion, which is different from the appearance readable from the first side.

Thus, it is possible to reveal the security markings with a different appearance on each side of the see-through portion when the see-through portion is enlightened under predetermined lighting conditions that are chosen and can be kept secret.

The specific lighting conditions depend mainly on the nature of the developer material and filtering material chosen. They can be Ultra-Violet radiations for example, when the developer material is luminescent ink, such as for example either fluorescent ink or bi-fluorescent ink, and when the filtering material is a UV filter. Furthermore, the UV radiations can be applied either on one side of the see-through portion or on both sides.

The specific lighting wavelengths can also be Infrared radiations. Then, the developer material can be in some way infrared active: IR transparent, IR absorbent, up-converting or specific IR reflection properties. Up-converting ink is fluorescent ink, which emits light of a shorter wavelength (higher in energy) than the light with which the ink is illuminated. Usually, this term is used for an IR fluorescent ink that emits visible light. The IR radiations can be applied on one side of the see-through portion or on both sides.

The specific lighting conditions can alternatively or in addition be a specific polarization, such as linear or circular polarization, in case of some embodiments, in which two polarizing filters are applied on both sides of said see-through portion and oriented perpendicular with each other. The first polarizing filter is used as a developer material while the second polarizing filter is used as a filtering material. Depending on the nature of the polarizing filters, the lighting conditions may be of specific polarization.

In a further embodiment, the developer and the filtering material are respectively an UV filter and an IR filter, or reciprocally. In this case, when it is enlightened on one side under either UV radiations or IR radiations, the data carrier has a see-through portion that allows revealing security markings from only said enlightened side while the window appears opaque from both sides. Nevertheless, in this particular example, the security markings remain visible from both sides and the see-through portion remains at least translucent under visible ambient radiations.

According to some embodiments, the constitution material of the translucent layer is chosen for being used as filtering material. In this case, the translucent layer can absorb at least partially some wavelengths used for lighting at least the see-through portion of the card. For example, said constitution material can be made of polycarbonate material, which filters some UV wavelengths.

Thus, the data carrier according to the invention has a see-through portion that allows revealing security markings, created within the see-through portion, with a different appearance in each side, i.e. that makes them visible with a different aspect or colour, and/or hidden, under specific lighting conditions.

According to another aspect of the invention, there is provided a method for producing a data carrier with a secured see-through portion. The method comprises the steps of providing a developer material in the see-through portion, said developer material being able to change the appearance of said security markings, under specific lighting conditions, and providing a filtering material in the see-through portion for filtering at least partially the lighting radiations, so that said security markings have another appearance from said second side, which is different from the first appearance visible from said first side.

Other aspects and advantages of the invention will become apparent from the following detailed description, taken in conjunction with the accompanying drawings, illustrating by way of example the principles of the invention.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

Hereafter, an embodiment of the present invention will be described in the context of identity (ID) card with a see-through portion and a method for producing it. However, it is to be understood that the invention is usable with any data carrier that includes at least one see-through portion. Such a data carrier includes, but is not limited to, a driving license, a badge or pass, a passport, a discount card, a membership card, a banking card, a credit card, a money card, a multi-application card, and other security documents and papers of value that are to be provided with information or data in such a way that they cannot be easily imitated by common means. It is also to be understood that the invention applies to any transparent data carriers.

Figure 1:
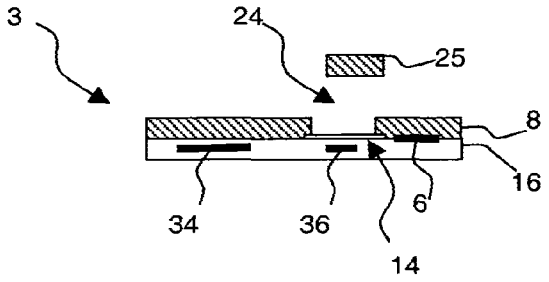
FIG. 1, already described, is a cross-sectional drawing of an existing data carrier with a see-through window.
Figure 2:
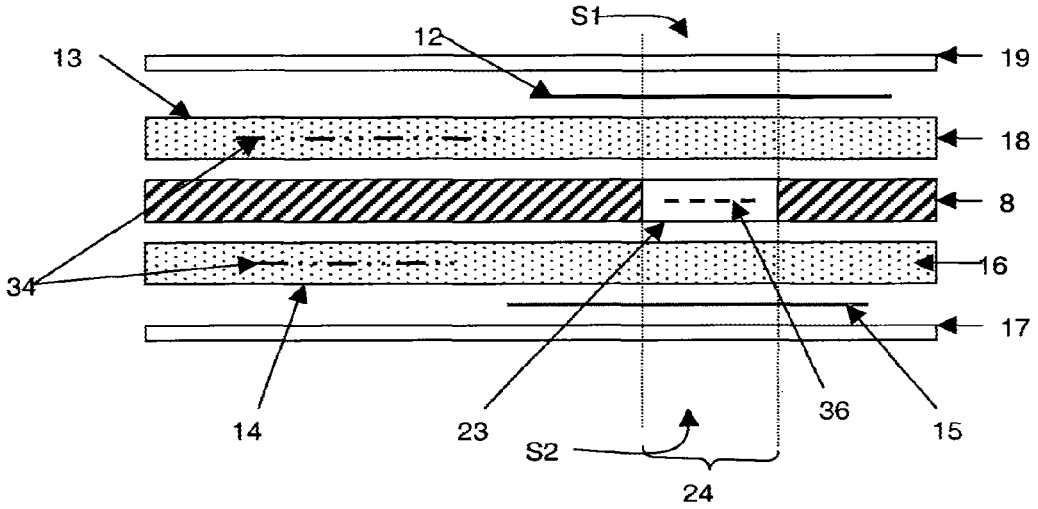
FIG. 2 is an exploded cross-sectional drawing of a data carrier with a see-through portion according to a first embodiment.

FIG. 2 shows an exploded cross-sectional view of a data carrier at different stages of its manufacturing process. The data carrier according to the invention can be manufactured according to any type of known manufacturing process. The process of the present invention relates rather to the increasing of security of a see-through portion of a data carrier, whichever is the manufacturing process of said see-through portion.

The data carrier of FIG. 2 comprises for example an at least translucent layer 16, which is intended to create the see-through portion. This layer is at least translucent, namely the light passes through the layer. This layer 16 can therefore also be transparent. It can be a laser-markable layer fabricated of clear polycarbonate with carbon particles therein. Other materials such as PET and PVC may also be used so long as they are able to absorb the energy of the laser beam for creating marking thereat.

The at least translucent layer 16 may be covered with a backing layer 8, in which holes have been punched in order to create the see-through portions of future data carriers. The backing layer 8 is less translucent than the translucent layer 16, which is intended to be a part of the see-through portion. It can be completely opaque. It is fabricated of plastic film materials customary in card application, such as Polycarbonate (PC), Polyethylene terephthalate (PET) and Polyvinyl chloride (PVC), etc. . . . . The backing sheet 8 and the translucent layer 16 are attached to each other for example by ultra-sonic bonding, or by thermal bonding, or the like. Although the present invention is described as implemented in this described embodiment, it is not to be constructed to be limited as such. Other materials, for example, papers or plastic materials, such as photographic papers, pass, documents, value bearing papers, checks, etc. may also be used as the opaque layer.

Each hole of the backing layer 8 is filled with a window piece 23, which is intended to be a part of the see-through portion. The window piece 23 can be a laser-markable layer and may be fabricated of plastic material such as PC or PET or PVC. The window pieces 23 is attached to the translucent layer 16 by a conventional way.

In the example of FIG. 2, other at least translucent layers 17, 18 and 19 cover the translucent layer 16 and the backing layer 8. The layer 18 above the backing layer 8 can be a laser-markable layer, as layer 16, fabricated of clear polycarbonate with carbon particles therein. Other materials such as PET and PVC may also be used so long as they are able to absorb the energy of the laser beam for creating marking thereat. Layers 17 and 19 are protection layers for protecting the data carriers against the ageing and the mechanical stresses.

In the example of FIG. 2, layers 16 and 18 comprise laser engraved printings 34. A laser beam (not shown) is irradiated to create these markings 34 at the transparent layers 16 and 18. These markings may include, but are not limited to, personalized information and data, such as name, date of birth, address, personnel number, signature, portrait, company logos, a serial number, a national or department emblem or initials etc. . . . . These markings 34 are created at portions of the transparent layers 16, 18 that are backed by the opaque layer 8, which aids legibility of the markings 34. A security feature 36, such as fingerprint, iris scan, hologram etc, is also created within the see-through portion 24 formed by the stacking of the transparent layers 16, 17, 18, 19 and the window piece 23. These markings 34, 36 may be created on an upper surface or a lower surface of one of the transparent layers or within the volume of one of the transparent layers 16-19 and 23. The markings 34, 36 may be colored, depending on the Laser used to create them and also the material used for the transparent layer. In the description, the markings 34, 36 are described to be laser engraved. Nevertheless, they may also be printed, etched, or otherwise arranged into the constitution layers before the attachment of the layers to each other, for example they may be made of an holographic layer inserted in between the constitution layers, without changing the scope of the protection. Furthermore, these markings 34, 36 can be created at any step of the manufacturing process.

A developer material 12 is provided in the see-through portion area, for example on the upper surface 13 of the transparent layer 18 which is intended to be attached to the protective upper layer 19.

The developer material 12 may be for example printable luminescent ink, which is colorless under visible lighting, but which reacts to invisible wavelengths radiations with a visible emission color. It can be for example fluorescing ink or bi-fluorescing ink; which has no body color, but which reacts to Ultra-Violet wavelengths. It can also be colorless printable up-converting ink that reacts to IR wavelengths with a visible emission color.

In another embodiment, the developer material may be a specific ink called "Oasis" and sold by the security printing ink producer Sicpa. This specific ink is almost transparent if placed on transparent background, but it emits a shiny color if placed on a dark surface. Thus, in this case, when security markings 36 are engraved in the see-through portion 24, for example in the window piece 23, they can be read from the first side S1, through the developer material 12, with an appearance of shiny color.

In another embodiment, the developer material 12 can also be an applied film, which consists of a polarizing filter for example. In this case, the specific lighting conditions are of specific polarization such as circular or linear polarization. The polarizing filter may be much more complex and can be for example a combined filter which reacts to specific lighting wavelengths such as either visible radiations or UV radiations or IR radiations, with a specific polarization.

Furthermore, a filtering material 15 is provided in the see-through portion area, for example on the lower surface 14 of the transparent layer 16 which is intended to be attached to the protective lower layer 17.

This filtering material 15 faces the developer material 12. It may be an UV filter for example. In this case, it includes, but not limited to, a clear printable varnish/lacquer mixed with a filtering additive that absorbs UV radiations.

In another embodiment, the constitution material of the translucent layer 16 itself can embody the filtering material. Indeed, if the translucent layer 16 is made of Polycarbonate for example, such a material absorbs some UV wavelengths such as 254 nm. In this case, if the data carrier is enlightened by such wavelength, polycarbonate absorbs this wavelength and doesn't react, so that no visible radiation is emitted.

In other embodiments, the filtering material 15 may also be either an infrared filter or a polarizing filter.

Then, the backing layer 8 and the translucent layers 16-19 are fixedly attached to each other using for example ultrasonic bonding, thermal bonding, appropriate adhesives or the like.

In the example of FIG. 2, the data carrier comprises a backing layer with only one hole intended to create the see-through portion 24 with other transparent layers. However, the invention applies also to an entirely transparent card, the whole surface of which defining the see-though portion.

In another alternative, the data carrier comprises more than one see-through portion. Furthermore, the see-through portion may be either of circular shape, or of any other shapes such as rectangular, oval, diamond, annular etc. . . . .

FIGS. 3A to 3G show exploded cross-sectional views of a see-through portion with security markings 36, a developer material 12 and a filtering material 15, each of these security elements being provided in the see-through portion with other different locations. It is also to be noted that the security markings, the developer and/or the filter can be either restricted to the see-through portion or can extend to the non-translucent part of the card.

Figure 3A:
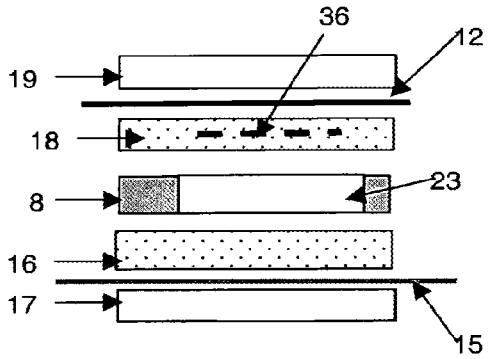
FIGS. 3A-3G are cross-sectional drawings of a see-through portion having a structure according to various alternatives.
Figure 3B:
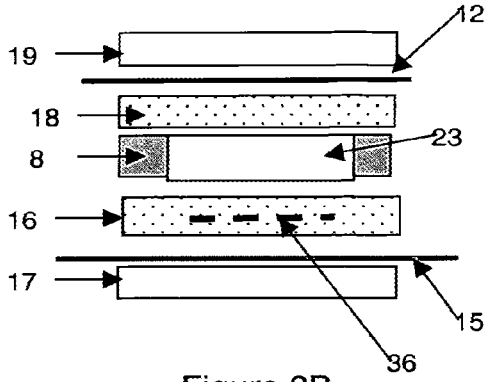

Thus, in FIG. 3A, the developer material 12 and the filtering material 15 are provided on the same location as in the data carrier of FIG. 2C. Only the security markings 36 are not laser-engraved in the window piece 23 but in the transparent layer 18, which covers the backing layer 8. They are located in the volume of the see-through portion 24, in an area above the window piece. In the same way, the security markings 36 can be laser-engraved in the transparent layer 16, which is covered by the backing layer 8, in an area just below the window piece 23, as illustrated in FIG. 3B.

Figure 3C:
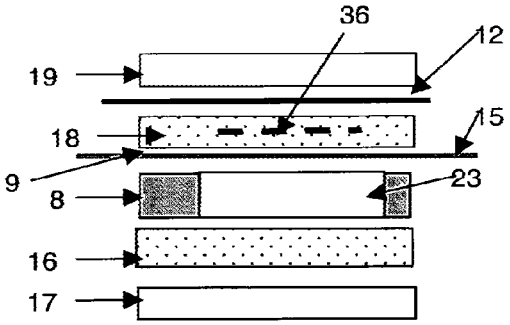

The filtering material 15 may also be provided on the inner surface 9 of the transparent layer 18, which covers the backing layer 8, as illustrated in FIG. 3C. In this case, the security markings 36 can be laser-engraved in the transparent layer 18, between the developer 12 and the filtering material 15.

Figure 3D:
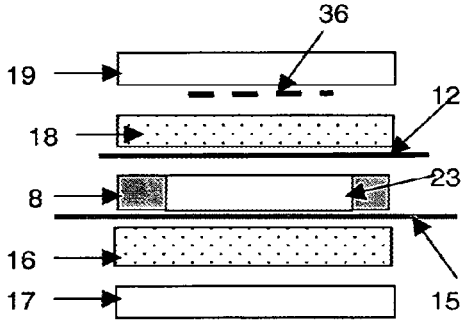

In another example illustrated in FIG. 3D, the developer material 12 and the filtering material 15 can be provided on each side of the window piece 23 while the security markings 36 are printed on the surface of the transparent layer 18, above the developer material and the filtering material.

Figure 3E:
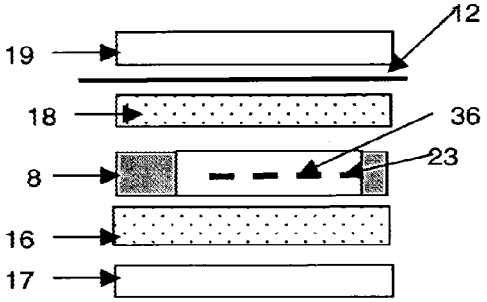
Figure 3F:
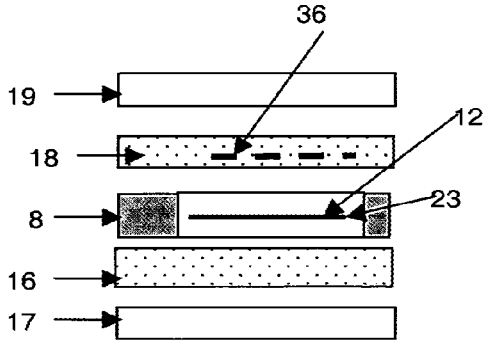
Figure 3G:
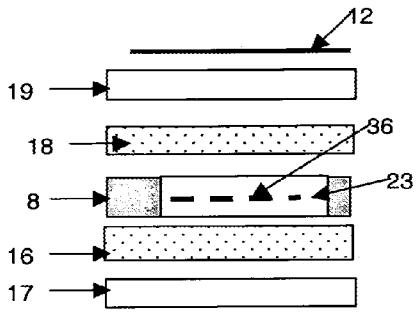

In a further example, the security markings 36 themselves may be used as a filtering material, as illustrated in FIGS. 3E to 3G.

Alternatives that have been described in view of FIGS. 3A to 3G are not exhaustive and the invention is of course not limited to these examples of structure.

Figure 4:
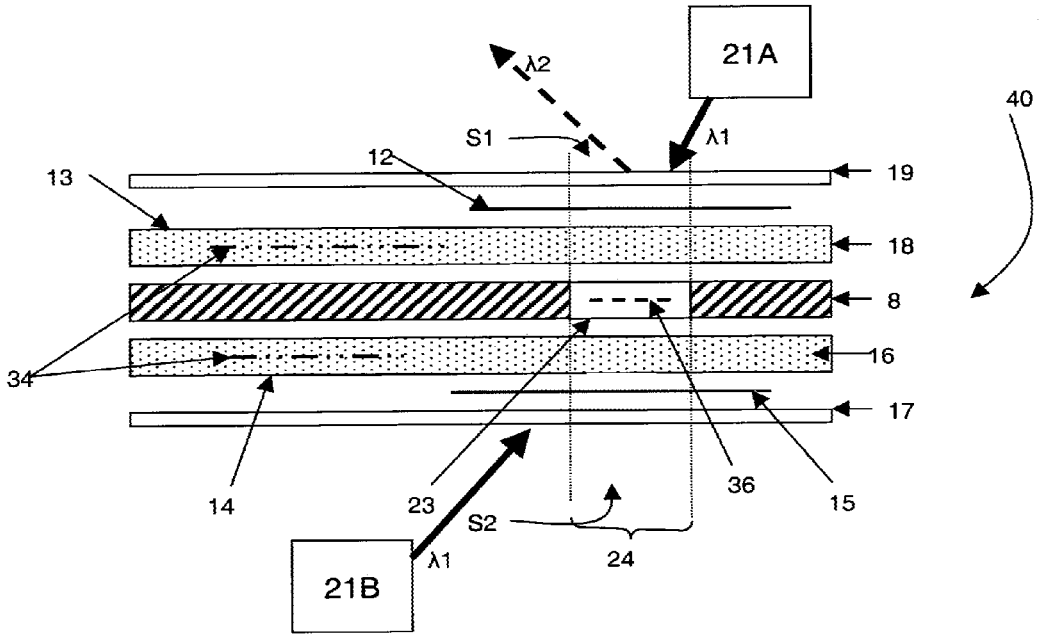
FIG. 4 is a cross-sectional drawing of a data carrier of the first embodiment in FIG. 2 enlightened under specific radiations.

FIG. 4 shows an exploded cross-sectional drawing of an ID card of a first embodiment. According to this embodiment, the see-through portion 24 comprises a developer material 12, such as for example fluorescing printable ink. A filtering material 15, such as an UV filter is also provided in the see-through portion 24. The security markings 36 are for example engraved in the window piece 23 between the developer and the filter.

Under visible ambient lighting, the see-through portion 24 appears transparent, and security markings 36 are visible from both sides of the see-through portion and with their original visible color, such as black for example. Then, when the see-through portion 24 is enlightened under predetermined UV wavelength radiations that depend on the nature of the developer material 12 and the filtering material 15 used, security markings 36 appear with another color from one side S1 of the see-through portion 24, while they are hidden from the other side S2. Indeed, when the see-through portion 24 is enlightened on its both sides S1, S2 with a UV light source, referenced respectively 21A and 21B, at a wavelength λ1 of 365 nm for example, then the fluorescing ink 12 is able to change the appearance of the security markings 36 from the first side S1 because it reacts to the UV radiation, such that a reflected wavelength λ2 is emitted with a visible color. On the other hand, the UV filter 15 enlightened with the same UV wavelength λ1 does not react with this wavelength and prevent any emission, or transmission through the see-through portion, of visible wavelength. Thus, in this case, security markings 36 enlightened under an UV wavelength λ1 appear visible with a specific colour from a first side S1, while they are hidden from the second side S2.

Figure 5:
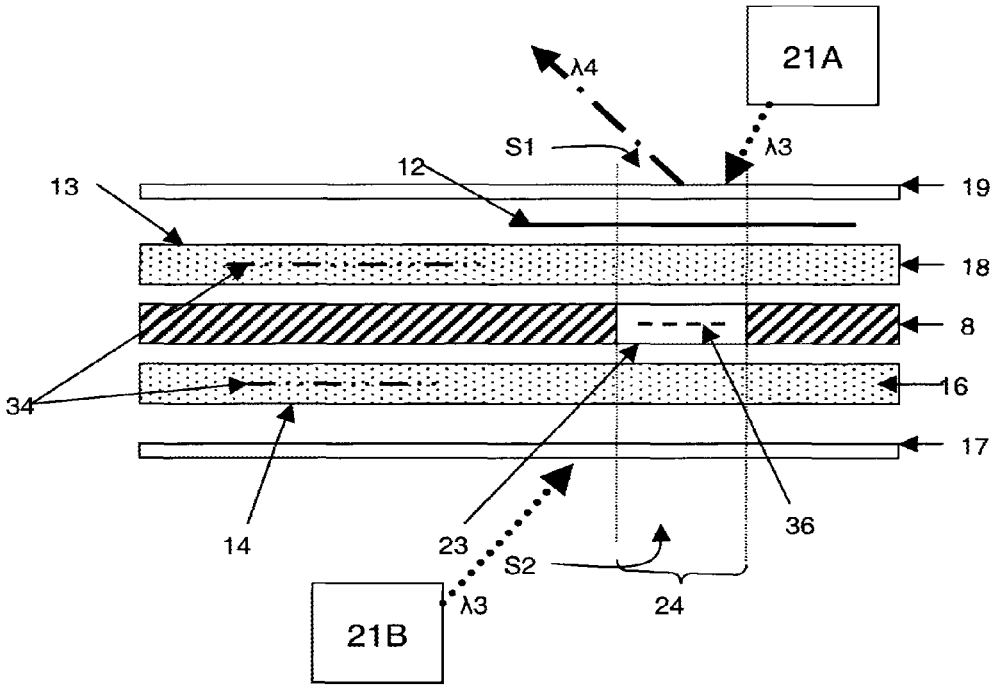
FIG. 5 is a cross-sectional drawing of a variant of the data carrier in FIG. 4 enlightened under specific radiations.

FIG. 5 shows an exploded cross-sectional drawing of a variant of the data carrier in FIG. 4. Namely, in this case the constitution material of the translucent layer 16 is chosen so that it can absorb some UV wavelength. For example, the translucent layer 16 may be made of polycarbonate. Such a material absorbs the UV wavelength of 254 nm. In this case, it is not mandatory to apply a filtering material, but the see-through portion 24 has to be enlightened with a UV wavelength λ3 of 254 nm in order that the fluorescing ink reacts to this wavelength with a visible emission color λ4, while the polycarbonate of the transparent layer 16 absorbs entirely the incident wavelength λ3 for hidden the security markings 36 from said second side S2.

In an alternative embodiment, the developer material can be up-converting ink, which reacts under IR wavelengths with emission of a fluorescent visible color. The filtering material can be an IR filter.

Figure 6:
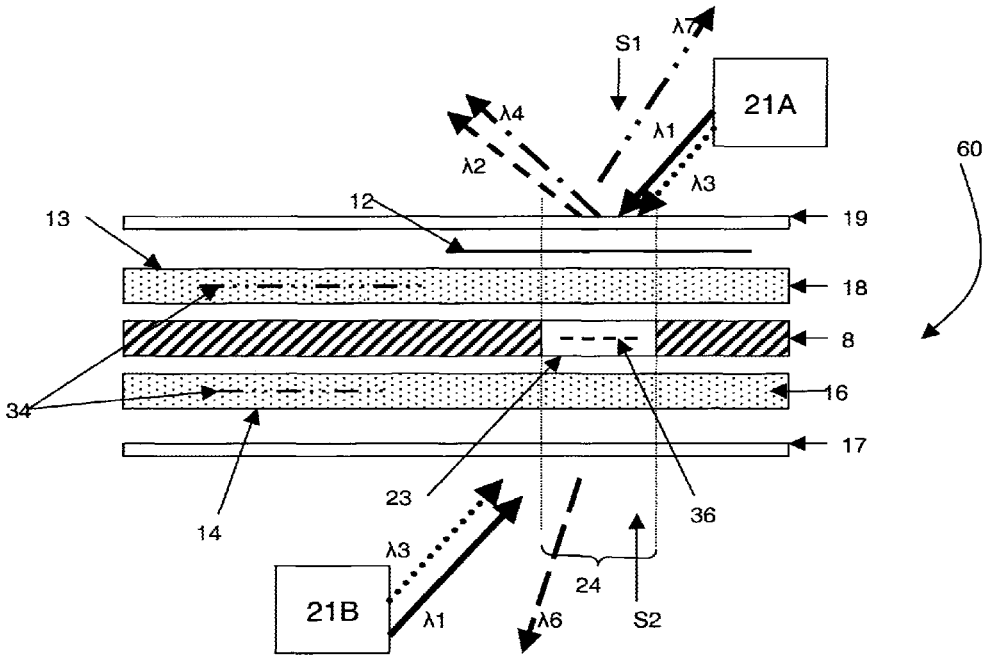
FIG. 6 is a cross-sectional drawing of a data carrier according to another embodiment enlightened under specific radiations.

FIG. 6 shows a cross-sectional drawing of a data carrier 60 according to another embodiment. In this embodiment, the developer material 12 is bi-fluorescing ink. In this case, the printable clear bi-fluorescing ink reacts to two excitation wavelengths λ1 and λ3, such that two reflected wavelengths λ2 and λ4 are emitted with two visible colors. In this case, the UV filter may be made either by a printable clear varnish/lacquer with an UV filter additive, or by the constitution material of the translucent layer 16 itself. If the UV filter is made for example with the constitution material of the transparent layer 16, then it may absorb at least one wavelength of lighting. Such a constitution material can be for example polycarbonate, which absorbs the wavelength at 254 nm.

Thus, when both sides of the see-through portion are enlightened with two UV wavelengths λ1 and λ3, such as for example 365 nm and 254 nm, by means of two UV light sources 21A, 21B, then the bi-fluorescing ink reacts and emits, by reflection, two visible colors at wavelengths λ2 and λ4, so that security markings appear with two mixed colors. Of course, the two enlightened wavelengths are not necessarily used simultaneously, but they can be used one after the other, and then one can observe the different emitted colors from the first side S1. On the other side S2, either the polycarbonate, or the UV filter, absorbs one wavelength, for example λ3 at 254 nm, so that the see-through portion becomes opaque under this enlighting wavelength. Moreover, the filter doesn't absorb the other wavelength λ1 of 365 nm so that security markings appear with their original color, i.e. black for example, from the second side. Of course other wavelengths not filtered by polycarbonate can be used, such as 313 nm for example.

Furthermore, the wavelength λ1 that is not absorbed by the filtering material can also be transmitted through the see-through portion. Indeed, if the wavelength λ1 is transmitted from light source 21B through the filter, the transparent see-through portion and the developer, then the security markings may be seen, from the first side S1, with another visible wavelength λ7 that is different from the other λ2, and λ4. On the other hand, when the wavelength λ1 is transmitted from light source 21A through the developer material 12, the transparent see-through portion 19, 18, 23, 16, 17 and optionally the filtering material in the event when the transparent layer 16 does not act as a filter, then the security markings 36 can be seen, from the second side S2, with another visible wavelength λ6 that may be different from λ2, λ4 and λ7.

According to this embodiment, under visible ambient lighting, the see-through portion appears transparent and security markings are visible with the same appearance and original color, for example black, from both sides of the see-through portion. Then, when the see-through portion is enlightened under predetermined UV wavelengths, the appearance of security markings changes and is different on both sides of the see-through portion.

In an alternative embodiment, security markings 36 can be applied in negative image. In this case, when the see-through portion is enlightened on its first side that comprises the fluorescent layer, shining UV light emits in return a visible colored light through the see-through portion coloring the transparent characters of the negative marking read from the second side of the see-through portion.

However, in the case where luminescent ink and UV filter are applied on the constitution layers of the see-through portion, it is important that at least one of the transparent layers 16-19, which covers the luminescent ink does not absorb some UV wavelengths. In this particular case it appears therefore to be preferable not to use polycarbonate for such covering transparent layer.

In a further embodiment, not illustrated, the security markings are provided in between the developer material and the filtering material. The developer material can be for example an UV filter and the filtering material can be for example an IR filter, or reciprocally. In this case, the see-through portion looks non-transparent with both UV and IR lighting wavelengths, but the security markings can be read under UV lighting from a first side and under IR lighting from the other side. In this case, the UV filter and IR filter can be made with visible colored inks, the first ink being UV transparent and the second ink being IR transparent. These filters can also be made respectively with UV and IR reflective inks. Namely, any combination of filters and reflectors can also be used.

A further variant may consist in mixing the IR or UV sensitive ink, which is used as developer material, with visible inks to give combinations of effects. Both sides of the see-through portion could be covered partially or completely by two of such mixtures, such that when illuminated with IR light for example, one of the mixtures lets the light pass through acting as developer, while the other blocks the light acting as filter, and reciprocally. The mixtures can be printed, and may have the same color, such that they cannot be distinguished under normal light source. In the case where a polarizing filter is used as developer, it can also be colored with visible ink in order to give also combinations of effects.

In a further embodiment, not illustrated, the developer material used can be a specific ink called "Oasis", sold by the ink manufacturer Sicpa. This ink is almost transparent if placed on transparent background, while it emits a shiny color when it is placed on a dark surface. In this case, when the security markings are read through the developer, they appear to have a shiny color, while they appear to be black when they are read from the other side of the see-through portion. The rest of the see-through portion looks essentially transparent from both sides. Moreover, the Oasis ink has the particularity to be sensitive to circular polarization of incident light, such that it becomes transparent if light polarization is in the right direction. Consequently, if a separate circular polarizing filter is applied on the ink used as developer, the shiny color of the read security markings disappears.

Figure 7:
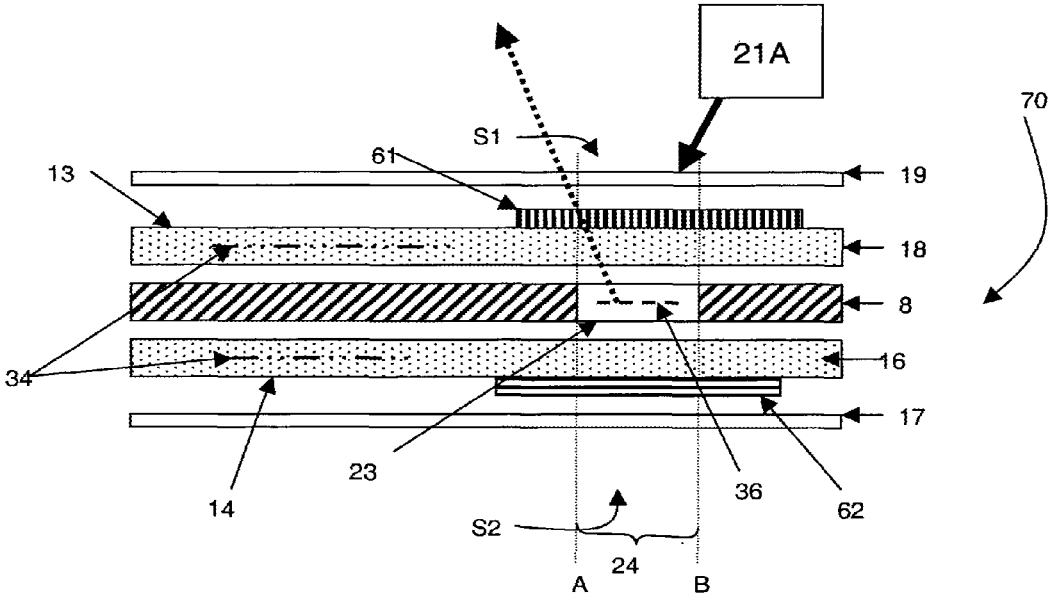
FIG. 7 is a cross-sectional drawing of a data carrier according to another embodiment enlightened under specific condition.

FIG. 7 shows an ID card 70 according to another embodiment. In this embodiment, the developer material and the filtering material used are two polarizing filters 61, 62. Each polarizing filter 61, 62 is oriented perpendicular, with each other. In this case, the first polarizing filter 61 constitutes the developer material, while the second polarizing filter 62 constitutes the filtering material. When the used polarizing filters 61, 62 are linearly polarizing, they are perpendicular with each other, while when they are circularly polarizing, they are opposite with each other. For simplification, the "perpendicular" word is used in both cases.

In this embodiment, the see-through portion has to be enlightened only on one side, by means of a light source 21A. Without the polarizing filters 61, 62, the region between the lines A and B and constituting the see-through portion 24 is transparent and the security markings are readily visible from both sides of the see-through portion. With the two perpendicular polarizing filters in the see-through portion, the security markings remain visible on each side where the see-through portion is enlightened, whereas the see-through portion stops being transparent. When the first side S1 is enlightened with a light source 21A, the security markings 36 appear visible through the first polarizing filter 61. However, the second polarizing filter 62 being oriented perpendicularly with the first one 61, it prevents the transmission of the light through the see-through portion, so that the see-through portion becomes opaque to the light. In this case, security markings 36 are visible on the enlightened side S1, while they are hidden on the other non-enlightened side S2, whatever is the enlightened side.

Although the polarizing filters are here depicted only in the see-through region, they could extend over the whole surface of the card body.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A data carrier having a see-through portion, the see-through portion of the data carrier comprising at least one translucent layer security markings provided within the see-through portion and laser-engraved on the at least one translucent layer, a developer material provided within the see-through portion, changing an appearance of the security markings when read from a first side of the see-through portion under specific lighting conditions, and a filtering material provided within the see-through portion, at least partially filtering lighting radiations, such that the security markings have another appearance from a second side of the see-through portion opposite the first side, which is different from the appearance readable from the first side, wherein the security markings are located between the developer material and the filtering material.

2. The data carrier according to claim 1, further comprising a backing layer provided on the at least one translucent layer, the backing material having at least one hole.

3. The data carrier according to claim 1, wherein the developer material comprises luminescent ink.

4. The data carrier according to claim 3, wherein the luminescent ink comprises fluorescent ink or bi-fluorescent ink.

5. The data carrier according to claim 1, wherein the developer material comprises an up-converting ink.

6. The data carrier according to claim 1, wherein the filtering material comprises a UV filter.

7. The data carrier according to claim 1, wherein the filtering material comprises an IR filter.

8. The data carrier according to claim 1, wherein the at least one translucent layer comprises a polycarbonate material.

9. The data carrier according to claim 1, wherein the developer material comprises a UV filter and the filtering material comprises an IR filter, or vice versa.

10. The data carrier according to claim 1, wherein the developer material comprises a first polarizing filter, and the filtering material comprises a second polarizing filter, the second polarizing filter being oriented perpendicular to the first polarizing filter.

11. The data carrier according to claim 10, wherein at least one of the polarizing filters covers a whole surface of the data carrier.

12. The data carrier according to claim 1, wherein the specific lighting conditions have specific polarization.

13. The data carrier according to claim 1, wherein the specific lighting conditions comprises UV lighting radiations emitted on at least the first side of the see-through portion.

14. The data carrier according to claim 1, wherein the specific lighting conditions comprise IR lighting radiations emitted on at least the first side of the see-through portion.

15. The data carrier according to claim 1, wherein the at least one translucent layer is transparent.

16. A method for producing a data carrier comprising a see-through portion having a first side and a second side, the see-through portion of the data carrier comprising at least one translucent layer and security markings laser-engraved on the at least one translucent layer, the method comprising:

providing a developer material in the see-through portion, the developer material configured to change an appearance of the security markings when read from the first side under specific lighting conditions, and providing a filtering material in the see-through portion for filtering lighting radiations at least partially, so that the security markings have another appearance from the second side, which is different from the first appearance visible from the first side, wherein the security markings are located between the developer material and the filtering material.

* * * * *